US009895690B2

(12) United States Patent
Zhang et al.

(10) Patent No.: US 9,895,690 B2
(45) Date of Patent: Feb. 20, 2018

(54) MICROFLUIDIC CHIP AND APPLICATION THEREOF

(71) Applicants: Capitalbio Corporation, Beijing (CN); Tsinghua University, Beijing (CN)

(72) Inventors: Guohao Zhang, Beijing (CN); Guoliang Huang, Beijing (CN); Can Wang, Beijing (CN); Su Guo, Beijing (CN); Lei Wang, Beijing (CN); Wanli Xing, Beijing (CN); Jing Cheng, Beijing (CN)

(73) Assignees: Capitalbio Corporation, Beijing (CN); Tsinghua University, Beijing (CN)

( * ) Notice: Subject to any disclaimer, the term of this patent is extended or adjusted under 35 U.S.C. 154(b) by 205 days.

(21) Appl. No.: 14/424,995

(22) PCT Filed: Aug. 23, 2013

(86) PCT No.: PCT/CN2013/001004

§ 371 (c)(1),
(2) Date: Feb. 27, 2015

(87) PCT Pub. No.: WO2014/032396

PCT Pub. Date: Mar. 6, 2014

(65) Prior Publication Data

US 2015/0217290 A1 Aug. 6, 2015

(30) Foreign Application Priority Data

Aug. 28, 2012 (CN) ..... 2012 1 0311357

(51) Int. Cl.
*B01L 3/00* (2006.01)

(52) U.S. Cl.
CPC ..... *B01L 3/502715* (2013.01); *B01L 3/5027* (2013.01); *B01L 2200/16* (2013.01);
(Continued)

(58) Field of Classification Search
CPC .. F28D 15/00; B01J 19/00; F17D 1/08; F17D 1/16; F17D 1/18; F15C 1/00; F15C 1/06;
(Continued)

(56) References Cited

U.S. PATENT DOCUMENTS 5,750,015 A * 5/1998 Soane ..... B01D 57/02 204/451
6,499,499 B2 * 12/2002 Dantsker ..... F16K 99/0001 137/1

(Continued)

FOREIGN PATENT DOCUMENTS

CN 1996009 A 7/2007
CN 101307834 A 11/2008

(Continued)

OTHER PUBLICATIONS

International Search Report for PCT/CN2013/001004 dated Dec. 5, 2013 in 3 pages.

*Primary Examiner* — Len Tran
*Assistant Examiner* — Gustavo Hincapie Serna
(74) *Attorney, Agent, or Firm* — Knobbe Martens Olson and Bear, LLP

(57) ABSTRACT

Provided is a microfluidic chip, which comprises a substrate and a cover sheet, wherein a microreactor array is arranged on the substrate and comprises at least one main channel (401) and at least two micro cells (402) connected to the main channel (401). The microfluidic chip also comprises at least one local temperature control device, which is used for heating the main channel (401) or cooling the micro cells (402). The use of the microfluidic chip ensures uniformity and independency of the micro cells (402). Also provided is an application of the microfluidic chip in biological detection or medical inspection.

6 Claims, 9 Drawing Sheets

(52) U.S. Cl.
CPC ... *B01L 2300/04* (2013.01); *B01L 2300/0803* (2013.01); *B01L 2300/087* (2013.01); *B01L 2300/0816* (2013.01); *B01L 2300/0864* (2013.01); *B01L 2300/1805* (2013.01); *B01L 2300/1822* (2013.01); *B01L 2300/1872* (2013.01); *B01L 2300/1894* (2013.01)

(58) Field of Classification Search
CPC .. F15B 21/00; B01L 3/5027; B01L 3/502715; B01L 2200/16; B01L 2300/04; B01L 2300/1822; B01L 2300/1872; B01L 3/00; B01L 2300/0803; B01L 2300/0864; B01L 2300/087; B01L 2300/18; B01L 2300/1805; B01L 2300/1894
USPC ..... 137/803, 806, 807, 833; 204/61; 165/104.21
See application file for complete search history.

(56) References Cited

U.S. PATENT DOCUMENTS 6,561,208 B1 * 5/2003 O'Connor ..... B01L 3/502738 137/15.18
6,664,044 B1 * 12/2003 Sato ..... B01J 19/0046 422/68.1
6,880,576 B2 * 4/2005 Karp ..... B01F 5/0471 137/806
6,981,522 B2 * 1/2006 O'Connor ..... B01F 5/064 137/559
7,105,812 B2 * 9/2006 Zhao ..... B01L 3/0268 250/281
7,686,040 B2 * 3/2010 Welle ..... F15C 1/04 137/828
7,935,318 B2 * 5/2011 Harding ..... G01N 35/025 422/502
7,989,214 B2 * 8/2011 Bianchessi ..... B01L 3/50851 422/551
8,084,085 B2 * 12/2011 Remy ..... B01J 19/0093 427/235
8,158,087 B2 * 4/2012 Caze ..... B01J 19/0093 422/211
2002/0122747 A1 * 9/2002 Zhao ..... B01L 3/502707 422/400
2003/0199081 A1 * 10/2003 Wilding ..... B01D 61/18 435/287.2
2005/0095602 A1 * 5/2005 West ..... B01F 5/061 435/6.19
2008/0032295 A1 * 2/2008 Toumazou ..... C12Q 1/6825 435/6.11
2009/0124025 A1 * 5/2009 Hamilton ..... B82Y 15/00 436/524
2009/0126516 A1 * 5/2009 Yamamoto ..... B01F 13/0071 73/864.22
2010/0151465 A1 * 6/2010 Ju ..... C12Q 1/6816 435/6.12
2011/0177618 A1 * 7/2011 Herr ..... B01L 3/502761 436/515
2012/0115246 A1 * 5/2012 Wimberger-Friedl ..... B01L 3/50273 436/501
2012/0181184 A1 * 7/2012 Whitesides ..... B01L 3/502 205/775

FOREIGN PATENT DOCUMENTS

CN 101906378 A 12/2010
CN 102886280 A 1/2013

* cited by examiner

MICROFLUIDIC CHIP AND APPLICATION THEREOF

TECHNICAL FILED

The invention relates to a microfluidic chip and its application, in the field of microfluidic and biological detection.

BACKGROUND TECHNOLOGY

Based on micro electro mechanical systems, microfluidic chip is a technique that microconduit forms a network on chip and controllable microfluid completes all kinds of biological and chemical processes throughout the whole system. In the early days of microfluidic chip, the chip capillary electrophoresis is the mainstream technology and the chip has simple structure and single function; in recent years, the microfluidic chip develops towards functionalization and integration rapidly, for example, DNA amplified reaction, immunoreaction, cell lysis and other important biological and chemical processes have become new hotspots. It needs to make a large number of independent and homogeneous microcells on chip to study these complex biochemical reactions and all microcells together make up a microreactor array.

There are two steps in constructing a microreactor array: step one, distribute the reagent to construct a large number of uniform microcells (see FIG. 1); step two, use a valve or medium to isolate the microcells and guarantee the homogeneity and independence of each microcell. For step one, there are a variety ways of reagent distribution at present, such as hydrophilic conduit type (CN1996009B), vacuum negative-pressure type (CN101590389A), centrifugal type (U.S. Pat. No. 6,627,159, US20050199500A1, US6919058B2, US20030166265A1, WO9533986A1), etc. For step two, the isolation mode of microcells is limited, only including conduit deformation isolation (U.S. Pat. No. 6,627,159), mineral oil/silicone oil isolation (CN101590389A) and natural air isolation.

Conduit deformation isolation uses external equipment to deform the metal substrate with pressure sensitive adhesive (PSA) and then blocks up the flow path. The drawback of this approach is that it cannot be automatical and has restrictive requirements for the material of chip substrate, and the composition of PSA may interfere with the reactor. Mineral oil isolation refers to add mineral oil after reagent distributing, and isolate by the difference in surface tension of oil and water. The drawback of this approach is that the user shall add samples two times, and because of the adhesive tape is often used to seal inlet and outlet of the chip so the mineral oil may erode the adhesive tape causing reagent leakage and environmental pollution.

Natural air isolation is that the original main channel changes into air after reagent distribution and uses the natural air space for isolation. The approach is easy to use and has a simple principle, but its drawback is also the most prominent. In actual use, the temperature of the chip containing microcells is generally controlled as a whole, however different areas of the chip are different in material and structural which cause the liquid in microcells to gradually evaporate and condense in the main channel which does not have liquid, and the condensed liquid droplets will gradually extend and form a liquid film. The evaporation firstly lead to different degrees of reagent reduction of each reaction cell, it damages uniformity of each microcell (see FIG. 2); The liquid film will connect each microcells resulting in cross contamination and damaging the independence of each microcell (see FIG. 3).

SUMMARY OF THE INVENTION

The invention relates to a microfluidic chip and its application. The microfluidic chip is fitted with local temperature control device to control the temperature of main channel in the chip to be higher than that in microcells, which can prevent reagent reduction effectively and then prevent condensed fluid to form a liquid film to guarantee the homogeneity and independence of each microcell In one embodiment, provided herein is a microfluidic chip, comprising a substrate and a cover plate; the substrate is fitted with a microreactor array; the microreactor array comprises at least one main channel and at least two microcells connecting to the main channel respectively;

The microfluidic chip also comprises at least one local temperature control device for heating the main channel or cooling the microcells.

In one embodiment, the microfluidic chip comprises two parallel main channels connecting with several microcells;

The local temperature control device is Pt electrode set in the cover plate in the position corresponding to the main channel.

In one embodiment, the microfluidic chip comprises two parallel main channels connecting with several microcells;

The local temperature control device is a cooling line set in a glass substrate affixed to the substrate or the cover plate and the position of the cooling line is corresponding to the microcells.

In a third embodiment, the microfluidic chip comprises a circular main channel linked by V lines; the microcell comprises a connected buffer area and reaction area; the top of each V line is connected with the buffer area;

The local temperature device is a circular resistive film which is set in the substrate or the cover plate and keeps a distance between substrate or the cover plate; the resistive film is in the position corresponding to the main channel.

For the above-mentioned microfluidic chip, the distance between the resistive film and the substrate or the cover plate is 0-0.5 mm, and the distance may not be 0; a location hole is set in the substrate or the cover plate in the position corresponding to the hollow part of resistive film.

For the above-mentioned microfluidic chip, the upper surface of the substrate is hydrophobicated with silylating reagent which can be octadecyltrichlorosilane, trimethoxyoctadecylsilane, octyltriethoxysilane, i-butyltriethoxanesilane, methyl triethoxysilane or its congeners and derivatives;

The cover plate is an aluminium sheet;

The microfluidic chip also comprises a mechanical deformation device, the boss of the mechanical deformation device is fitted with several cylindrical embossments; the cylindrical embossments are in a circular array and in the position corresponding to several buffer areas.

In a fourth embodiment, the microfluidic chip comprises several rows of connected main channels in a rectangular arrangement; the main channel is linked by V lines and the top of each V line is connected with the microcells;

The local temperature control device comprises Peltier, several aluminium blocks with thermal conductivity are set in the Peltier; when the Peltier is worked with the substrate or the cover plate, the aluminium blocks with thermal conductivity are in the position corresponding to the main channel.

In a fifth embodiment, the microfluidic chip comprises a spiral main channel, and the outer wall of the main channel connects with several weighing tanks connecting with the microcells;

The local temperature control device comprises a ring aluminum foil and several LED lights in a circular array; the ring aluminum foil is affixed to the substrate or cover plate and in the position corresponding to the main channel; the LED lights are set on the ring aluminum foil and keep a distance with the foil.

For the above-mentioned microfluidic chip, the distance between LED lights and the ring aluminum foil is 0-10 mm, and the distance may not be 0; a location hole is set in the substrate or the cover plate in the position corresponding to the hollow part of aluminum foil.

In a sixth embodiment, the microfluidic chip comprises one circular main channel linked by several oval areas connected with the microcells;

The local temperature control device is one copper ring affixed to the described substrate or the cover plate in the position corresponding to the microcells.

For the above-mentioned microfluidic chip, a location hole is set in substrate or the cover plate in the position corresponding to the hollow part of copper ring.

The method using the above-mentioned microfluidic chip to guarantee the homogeneity and independence of each microcell, comprising: opening the local temperature control device to heat the main channel or cool the microcells, controlling that the temperature of main channel is higher than that in microcells, to guarantee the homogeneity and independence of each microcell.

The invention also provides the application of the above-mentioned microfluidic chip in biological detection or medical examination which may be immunoassay, nucleic acid amplification reaction, analysis of nucleic acid hybridization reaction or protein-receptor binding reaction.

The description of reference symbols is as follows:

001 substrate; 002 cover plate; 401 main channel; 402 microcells; 403 local temperature control area; 501 Pt electrode; 601 reaction area; 602 buffer area; 603 location hole; 701 resistive film; "d" referring to a distance between the resistive film and the substrate or the cover plate; 1001 weighing tank; 1002 aluminum foil ring; 1101 infrared LED; 1201 cylindrical embossments; 1301 copper ring; 1401 cooling line.

DETAILED DESCRIPTION OF THE INVENTION

Unless stated, all experiment methods used in the following examples are conventional method.

Unless stated, all materials, reagents and etc used in the following examples can be obtained in a business approach.

In the following examples, the chip-manufacturing technology and its usage are the routine techniques and methods in the field of microfluidic chip and biological detection.

Embodiment 1

The local temperature control area is in the main channel, the local temperature control device is Pt electrode on chip.

Figure 1:
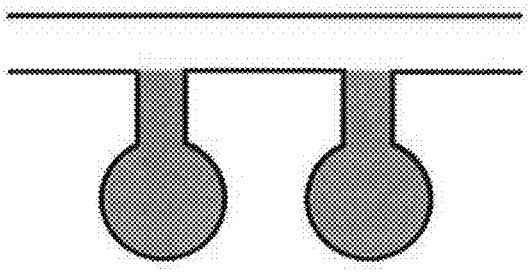
FIG. 1 is a microcell diagram in the current microfluidic chip after distributing the reagent.
Figure 2:
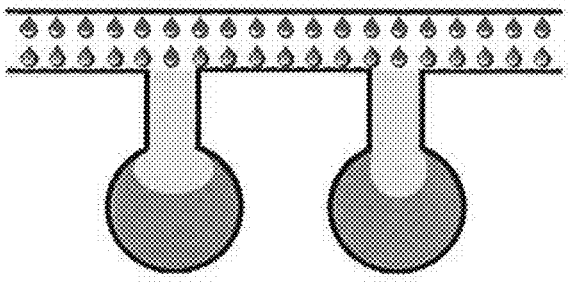
FIG. 2 is a microcell diagram under the overall temperature control for the current microfluidic chip, and the liquid volume in each microcell is not homogeneous at that time.
Figure 3:
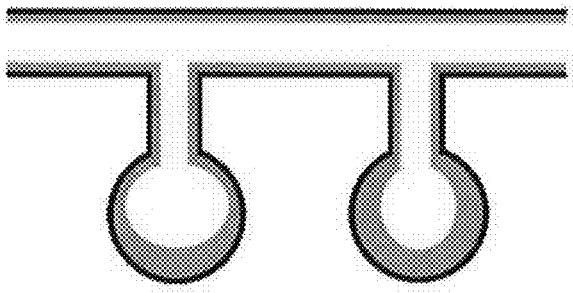
FIG. 3 is a microcell diagram under the overall temperature control for the current microfluidic chip, and the liquid in each microcell is not independent at that time.
Figure 4:
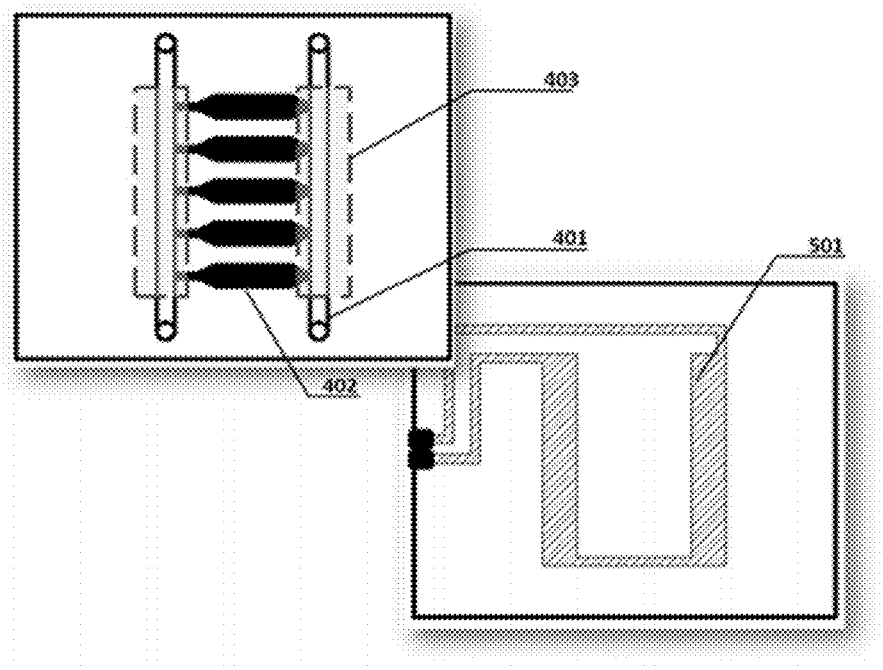
FIG. 4 is a diagram of microfluidic chip in embodiment 1.

As shown in FIG. 4, the microfluidic chip contains two layers, the substrate is a 4 mm Polymethyl Methacrylate (PMMA) layer, the cover plate is a 2 mm glass layer; a microreactor array is set on the upper surface of the substrate, the microreactor array is designed by the technical solutions of patent CN1996009B. The microreactor array comprises two parallel main channels 401, the two main channels are connected with several microcells 402, the microcells 402 is a spindle-shaped structure, 6 mm at its widest point, and the volume of each microcell is 144 μL; the width of the main channel is 4 mm, the depth of all structures is 1 mm. The Pt electrode 501 (slant area), corresponding to the position of main channel 401, is set on the cover plate to form the local temperature control area 403.

The above-mentioned microreactor array can be manufactured by laser engraving, machining, hot-pressing sealing and other available technologies. The Pt electrode 501 can be manufactured by sputtering, wet etching or other prior art. The PMMA cover plate and the glass substrate bonded into a whole by glue. Connecting the Pt electrode 501 to external power is to heat the local temperature control area 403 by electrode resistance and avoid heating microcells 402.

The reagent is SDS solution (10% W/V). The reagent distribution is referring Embodiment 1 in patent CN1996009B. Noted that the used immiscible and nonreactive fluid is air, that is to say only microcells in microfluidic chip contain reagent while the rest part is air. After reagent distribution, the inlet and outlet of chip shall be sealed and the chip is put into a dryer for integral heating at 40 □; the temperature of local temperature control area shall be 90° C. through Pt electrode heating at the same time. The temperature of the main channel is always higher than that in microcells during the heating process.

The chip without Pt electrode is set as a control.

After heating for one hour, take the chip out of the dryer and observe the volume change of solution in microcells by microscope. In experimental group, there is basically no bubble in microcells, no liquid drop or liquid film appears in main channel, which illustrates that the homogeneity and independence of microcells can be ensured. However, the microcells of control group contain bubbles of all sizes and the liquid film connects each microcell, which illustrates that the homogeneity and independence of microcells in control group have been damaged.

Embodiment 2

Figure 5A:
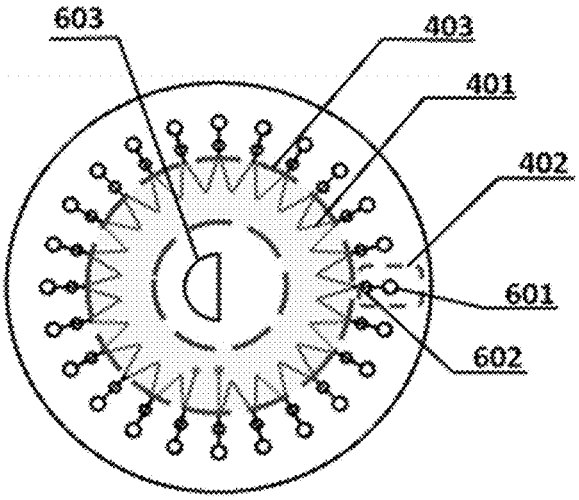
FIG. 5A is an upper view of microfluidic chip in embodiment 2.
Figure 5B:
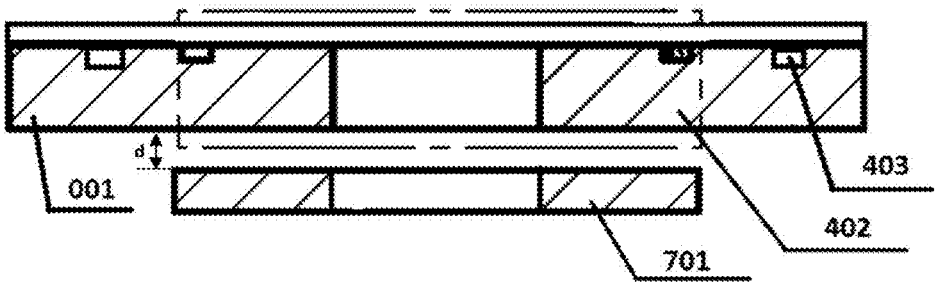
FIG. 5B is a side view of microfluidic chip in embodiment 2, wherein the resistive film is set in the substrate.
Figure 5C:
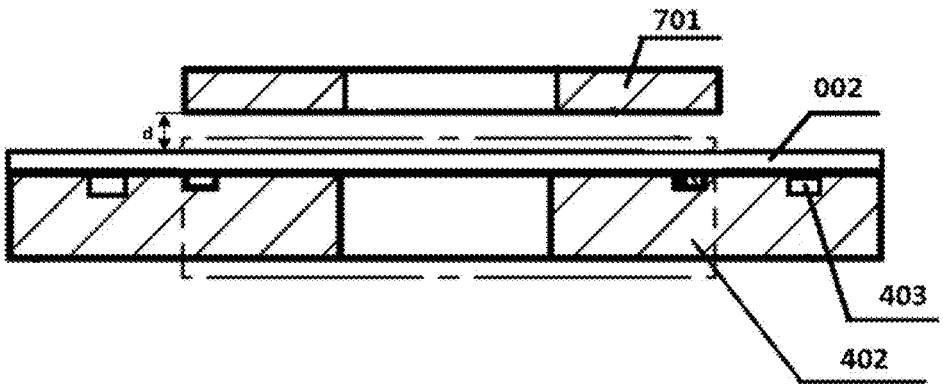
FIG. 5C is a side view of microfluidic chip in embodiment 2, wherein the resistive film is set in the cover plate.

The local temperature control area is in the main channel and the local temperature control device is a resistive film outside the chip As shown in FIGS. 5A-5C, the microfluidic chip in this embodiment contains two layers that the cover plate 002 is a 0.1 mm PMMA film while the substrate 001 is a 2 mm PMMA layer. The upper surface of substrate sets a microreactor array which be manufactured by laser engraving, machining, hot-pressing sealing and other available technologies. The substrate and the cover plate are bonded into a whole by glue.

Figure 6:
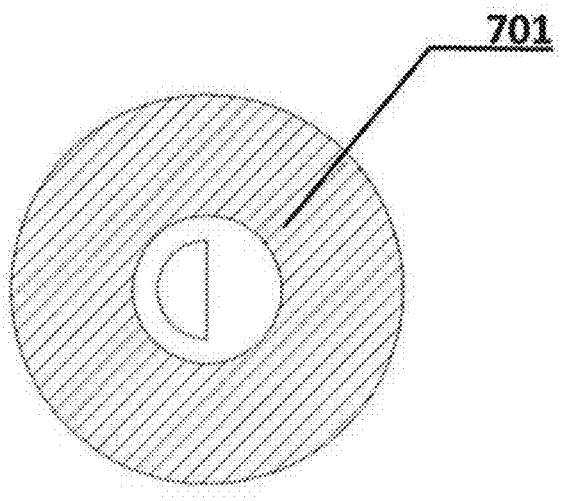
FIG. 6 is a diagram of resistive film in embodiment 2.

The microreactor array comprises a main channel 401 and 24 microcells 402 connected to the main channel 401 in parallel with an equal distance between each microcell 402; the main channel 401 is a circular channel made by 24 linked V-shaped lines; the microcells 402 comprise the connected reaction area 601 and the buffer area 602; the top of each V line is connected with one buffer area 602; the buffer area is cylinder, with a basal diameter of 1.5 mm; the reaction area 601 is also cylinder, with a basal diameter of 2 mm. The local temperature control device is a ring resistive film 701 (see FIG. 6), the resistive film is above the cover plate with a distance of 0.5 mm from the cover plate. The resistive film 701 is opposite to the main channel 401 forming the local temperature control area 403; a rotation axis location hole 603 is set in the position in the substrate and the cover plate corresponding to the hollow part of resistive film 701, which is a semicircle, with a radius of 5 mm.

Conducting isothermal amplification reaction with the chip and associated apparatus, the experimental procedures and results are shown as below:

I. Chip Preparation

Primer sequence is as follows:

A: TTGTAAAACGACGGCCAGTG,

B: GACCATGATTACGCCAAGCG,

C: GCTTATCGATACCGTCGACCTCGTACGACTCACTATAGGGCGAAT,

D: CAGCCCGGGGGATCCACTAGCCTCACTAAAGGGAACAAAAGC;

After dissolving primer A, B, C and D in water, obtain the aqueous solution containing four primers (the concentration of A, B, C and D in the solution is 0.1 μmol/L); take 0.7 μL, mixed liquor of the primers to spot on the odd reaction areas of the PMMA film (namely 1, 3, 5, 7, 9, 11, 13, 15, 17, 19 21 and 23 are positive) and do not spot on even reaction areas (namely 2, 4, 6, 8, 10, 12, 14, 16, 18, 20, 22 and 24 are negative). The chip after spotting is put into a dryer at 50° C. and take out 30 minutes later (primer is in a solid state, affixed to the bottom of the reaction area at that moment). Seal the substrate and cover plate of chip and store at room temperature.

II. Reagent Sample and Distribution

The amplified reaction liquid comprises reaction system and template. The composition of the reaction system is shown as below:

| No. | Composition of Reactant | Final Concentration |
|---|---|---|
| 1 | Bst DNA polymerase fragment<br>Bst enzyme reaction buffer | 0.32 U/μl |
| 2 | ThermoPol Reaction Buffer | 1 x |
| 3 | deoxy-ribonucleoside triphosphate(dNTPs) | 0.4 mmol/L(each) |
| 4 | EvaGreen dye | 0.6 x |
| 5 | Bovine serum albumin (BSA) | 0.5 mg/ml |
| 6 | betaine | 0.8 mol/L |

The template is EZ-T carrier vector DNA purchasing from Beijing GenStar Biosolutions Co., Ltd. Art. No.: T168-10, concentration: $10^5$ copies/μL. The reaction system: template=23:2, v/v.

Use an injection pump to add samples into the main channel 401 at 60 μL/min flow rate. Seal the injection inlet and outlet after the reagent flows into the main channel. The chip is fixed on the rotation axis of centrifuge, and centrifuged at 5000 rpm. The reagent flows into the reaction area 601 of microcells 402 from the main channel 401 after 30 s and the remaining air is in the main channel 401, therefore, the reagent distribution process is completed.

III. Detection

Put the chip into a detecting instrument, the overall temperature-controlled equipment of the instrument controls the bulk temperature of chip to keeps 67° C. for 73 min; at the same time, the temperature of the resistive film 701 in the instrument keep 69° C. for 73 min. Therefore, the temperature of the local temperature control area 403 is higher than the temperature in microcells 402 during the detection process.

Detecting instrument without resistive film is set as control, comparing the differences of positive amplification time (Tp value) and negative amplification. The reagent and chip of control group are same with those of experimental group.

The effect of amplification reaction can be tested by real-time fluorescence detection. Fluorescent dye is used to indicate the reaction degree. Only the reaction area 601 of microcells 402 is detected.

IV. Experimental Result

Figure 7:
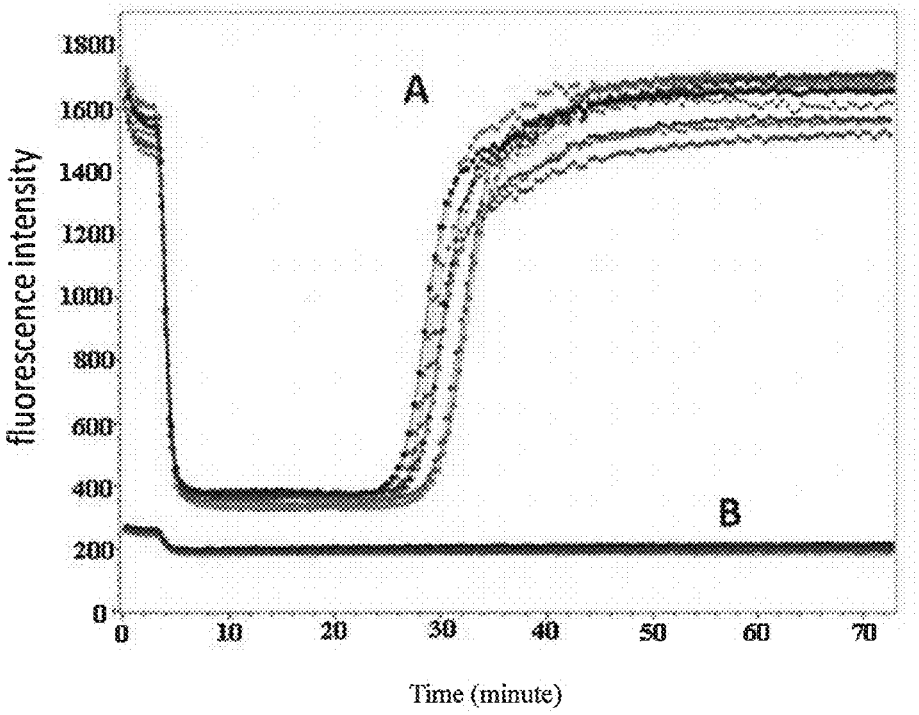
FIG. 7 is a fluorography of isothermal amplification reaction for the experimental group in embodiment 2.
Figure 8:
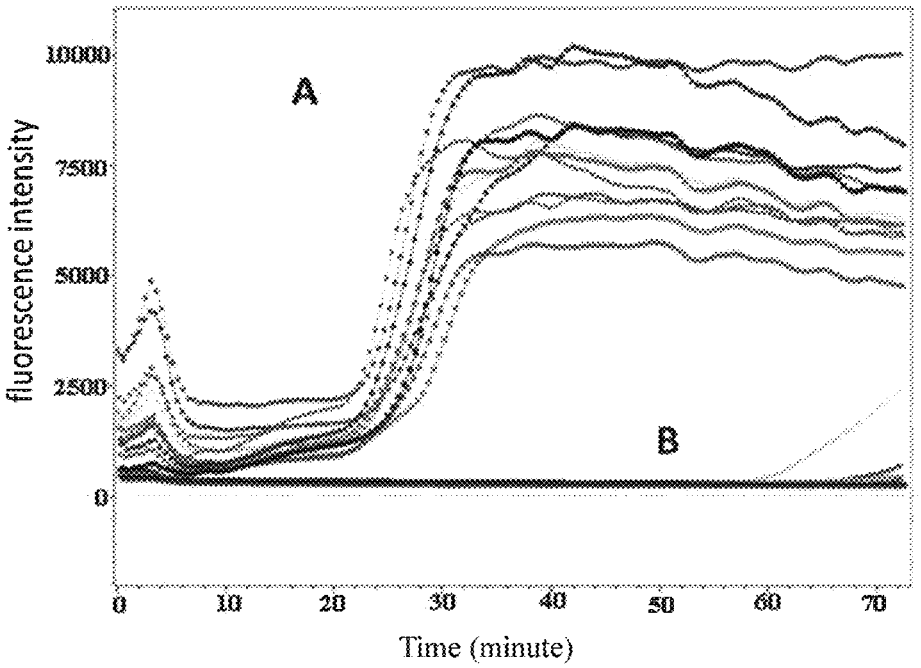
FIG. 8 is a fluorography of isothermal amplification reaction for the control group in embodiment 2.

FIG. 7 is an amplification curve that the fluorescence intensity of isothermal amplification reaction changes with reaction time of experimental group; FIG. 8 is an amplification curve of control group. A refers to odd reaction areas while B refers to even reaction areas.

As shown in FIG. 7, the amplification curve of odd reaction areas from experimental group (the local temperature control area 403 is heated by the resistive film 701) is smoothing, no obvious jitter and Tp value of each reaction area has small differences; even reaction areas show no amplification within 73 min and keep negative. This shows that the reagent volume of each reaction area 601 is unchanged, and there is no bubble in reaction area 601. There is no cross contamination between odd and even reaction areas.

As shown in FIG. 8, the amplification curve of odd reaction areas from control group (local temperature control area 403 is not heated by resistive film 701) has obvious jitter which exerts great influence on software interpretation and Tp value of each reaction area shows big differences; even reaction areas show false positive amplification on 58 min. This shows that the reagent volume of each microcell is reduced in varying degrees. The different reaction volumes sharply enlarge the differences of Tp value and the bubbles interfere the instrument detection causing jitter of amplification curve; with the continuous evaporation of liquid in microcells and condensation in the main channel, liquid film connects odd and even reaction areas, which causes even reaction areas to show false positive amplification.

Take the chip out of the detecting instrument after the reaction and obverse the volume change of the microcells by microscope. It reveals that there is basically no bubble in microcells of experimental group while the microcells of control group have bubbles of all sizes. These phenomena agree with the result of amplification curve.

The experiment shows that the resistive film 701 heats the local temperature control area 403 of the chip (main channel region) to avoid the reagent in microcells being condensed in other regions. The reaction solution volume of microcells is constant during the reaction process and there shows no cross contamination among each microcell, that is to say the homogeneity and independence of microcells can be ensured.

Embodiment 3

The local temperature control area is in the main channel and the local temperature control device is an infrared LED light outside the chip.

Figure 9:
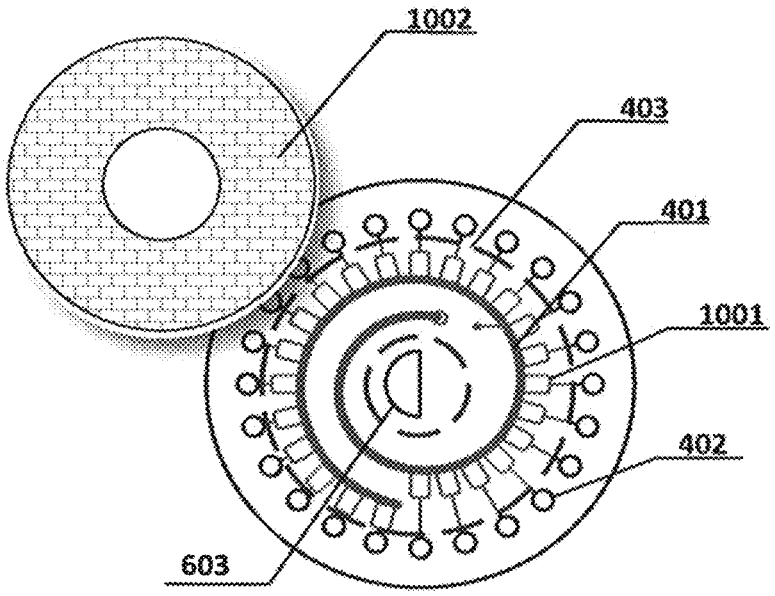
FIG. 9 is a diagram of microfluidic chip in embodiment 3.
Figure 10:
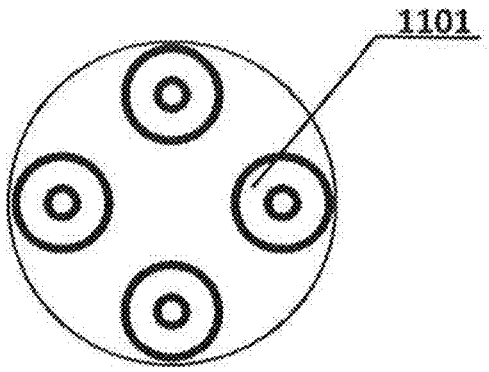
FIG. 10 is a diagram of infrared LED heating device in embodiment 3.

As shown in FIG. 9, the microfluidic chip in the embodiment contains three layers that the upper layer is a 0.05 mm aluminum foil ring 1002, the middle layer is a 0.1 mm PMMA film (cover plate) and the lower layer is a 2 mm PMMA layer (substrate). A microreactor array is set on the upper surface of the lower substrate. The microreactor array comprises a spiral main channel 401 with a lateral wall connected to 24 weighing tanks 1001 evenly distributed, the weighing tanks 1001 is connected to microcells 402; the width of the main channel 401 is 1.5 mm; the microcell 402 is cylinder, with a basal diameter of 2 mm; the aluminum foil ring 1002 is attached to the cover plate, the aluminum foil ring 1002 is in the position corresponding to the main channel 401 forming local temperature control area 403; as shown in FIG. 10, the local temperature control device is 4 infrared LED 1101 in a ring arrangement with 850 nm wave length and 5 W power; infrared LED 1101 is set above aluminum foil ring 1002 and has a 10 mm distance between the foil ring; a semicircle rotation axis location hole 603 radius of 5 mm is set in the position in substrate and cover plate corresponding to the hollow part of aluminum foil ring 1002.

Use an injection pump to add samples into the main channel 401 at 60 μL/min flow rate. Seal the injection inlet and outlet after the reagent flows into the main channel 401. Centrifuge the chip at 600 rpm. The reagent flows into each weighing tank 1001 in turn from spiral main channel 401 after 30 s; then centrifuge at 5000 rpm, the reagent flows into the microcells 402 from weighing tank 1001 after 10 s. The remaining air is in the main channel 401 and weighing tank 1001, therefore, the reagent distribution process is completed.

The detection process of the chip is the same as embodiment 2. When infrared LED 1101 irradiating, the aluminum foil ring 1002 absorbs heat and raises the temperature of the main channel 401 while the temperature of other regions of the chip is almost unchanged due to low absorption of infrared of PMMA. The temperature in the main channel 401 can be controlled from 68° C. to 72° C. through controlling voltage and irradiation time of the infrared LED 1101. The overall temperature control equipment of the detecting instrument controls the temperature of the microcell area of the chip to be 67° C.

After heating one hour, take the chip out. It shows that the reagent volume of each microcell almost remains unchanged by microscope. Only a small amount of bubbles are in microcells, no liquid drop or liquid film appears in main channel, which illustrates that the homogeneity and independence of microcells can be ensured.

Embodiment 4

The local temperature control area is in the main channel and the local temperature control device is a resistive film outside the chip; the chip comprises local temperature control area, buffer area and hydrophobic surface at the same time.

The microfluidic chip in embodiment 4 is similar to embodiment 2, but 0.1 mm PMMA film in upper layer is changed into 0.1 mm aluminum sheet. Moreover, hydrophobic treatment is done with the PMMA substrate shown as below: take a cleaned PMMA chip to treat with plasma with the condition that $O_2$ flow is 40 sccm, pressure is 18 pa, plasma power is 130 W and the duration is 10 min. Immerge the treated chip into the solution of trimethoxyoctadecylsilane (1%, V/V, the solvent is normal hexane) and take out the chip after four hours (protect by nitrogen in advance). Use normal hexane to clean the chip and dry it. Put the chip into a dryer at 70° C. under vacuum conditions and dry for one hour. Then use absolute methanol to clean and put into a dryer under vacuum conditions for two hours.

Figure 11:
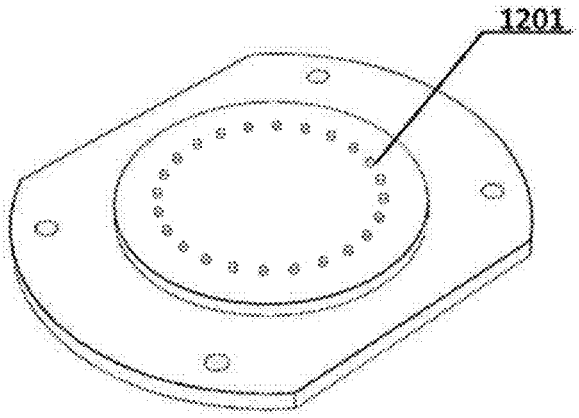
FIG. 11 is a diagram of mechanical deformation device in embodiment 4.

The reagent distribution process is the same as embodiment 2, and after that the inlet and outlet of chip is sealed. The mechanical deformation device (see FIG. 11) is inverted on the chip. 24 cylindrical embossments 1201 on the mechanical deformation device should be in corresponding position to 24 buffer areas 602. Pressed by hand, the upper aluminum foil membrane of the chip will be sunk into buffer area 602. Adjusting manual pressure, the sunken aluminum foil membrane can completely cut off the gas-liquid transmission path between the reaction area 601 and the main channel 401.

The reaction and detection process of chip is the same as embodiment 2. Take the chip out after one hour. It shows that the reagent volume of each microcell remains unchanged, no bubble in microcells, no liquid drop or liquid film appears in main channel, which illustrates that the homogeneity and independence of microcells can be ensured.

In this embodiment, three methods, namely temperature rise of local temperature control area, deformation of buffer area and chip hydrophobization, are used to guarantee the independence of microcells, avoiding cross contamination among microcells. Even if any two of the three methods lose efficacy, the remaining method is still valid. The temperature rise of local temperature control area can reduce the condensation of reagent in other regions as far as possible, the deformation of buffer area can completely cut off gas-liquid transmission among microcells and the hydrophobic surface, which fails to reduce evaporation, but can gather the condensed reagent into isolated liquid drop rather than unfolded liquid film to avoid the connection among microcells.

Embodiment 5

The local temperature control area is in microcell area, the local temperature control device is copper cooling ring.

Figure 12:
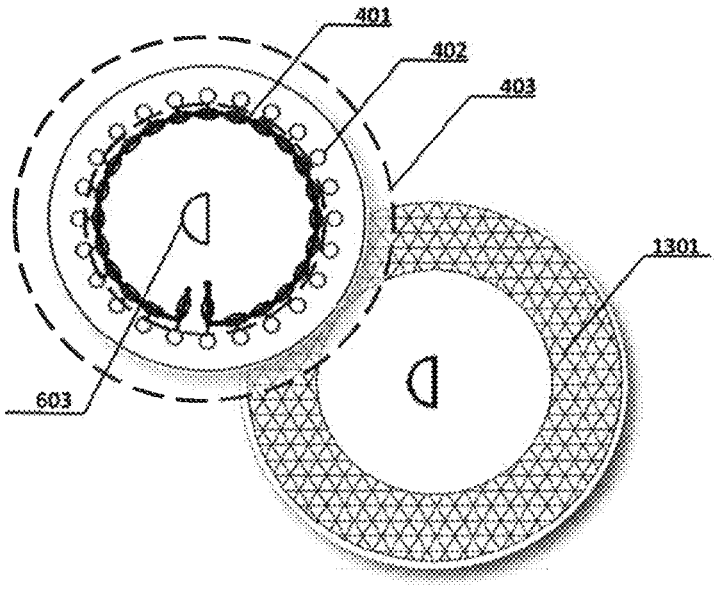
FIG. 12 is a diagram of microfluidic chip in embodiment 5.

As shown in FIG. 12, the chip in embodiment 5 contains three layers that the upper layer is a 2 mm PMMA cover plate, the middle layer is a 1 mm PMMA substrate and the lower layer is a copper ring 1301. A microreactor array is set on the upper surface of middle PMMA substrate. The microreactor array can be manufactured by laser engraving, machining, hot-pressing sealing and other available technologies. The upper PMMA cover plate and the middle PMMA substrate are bonded into a whole by hot-pressing. The lower copper ring 1301 and the chip are bonded into a whole by glue.

The microreactor array of middle PMMA substrate comprises a circular main channel 401 connected by 24 oval areas; each oval area is connected to the microcells 402; the oval area is a 4.5 mm long axis and 2 mm short axis with a depth of 0.7 mm; the width of other regions in main channel 401 is 1 mm and the depth is 0.2 mm; the microcell 402 is cylinder, with a basal diameter of 3 mm, and depth of 0.7 mm; local temperature control device is a copper ring 1301 with a thickness of 1 mm, attached to the cover plate in the position corresponding to the microcell 402 to form local temperature control area 403; a rotation axis location hole 603 is set in the position in the substrate or the cover plate corresponding to the hollow part of copper ring 1301, which is one semicircle, with a radius of 5 mm.

Local temperature control area 403 is in the microcell area and the copper ring 1301 is used to cool the local temperature control area 403. The light path of detecting instrument detect signals through the transparent cover plate of upper PMMA, therefore the copper ring has no impact on signal acquisition. The diameter of the chip is 62 mm and the diameter of the ring is 75 mm, so the exterior of the copper ring is exposed outside the overall temperature control device (Not shown in the figure) of detecting instrument. The heat conductivity coefficient of copper is 401 W/(m·K), so the copper ring has a cooling effect in microcell area at that moment.

The reagent distribution process is similar to embodiment 2 that the reagent is centrifuged into microcells 402. The remaining air is in oval area and other regions of the main channel 401. The detection process of the chip is also similar to embodiment 2, put the chip into a detecting instrument and its overall temperature control device (Not shown in the figure) keeps the bulk temperature of the chip 67° C. for 73 min; due to heat radiating effect of the copper ring, the actual temperature of the local temperature control area is 66.9□, hence the temperature of microcells 402 is lower than the temperature in main channel 401 during the detection process.

Take the chip out after one hour. It shows that the reagent volume of each microcell almost remains unchanged. Only a small amount of bubbles are in microcells, no liquid drop or liquid film appears in the main channel, which illustrates that the homogeneity and independence of microcells can be ensured.

Embodiment 6

The local temperature control area is in microcell area, the local temperature control device is equipped with cooling lines.

Figure 13:
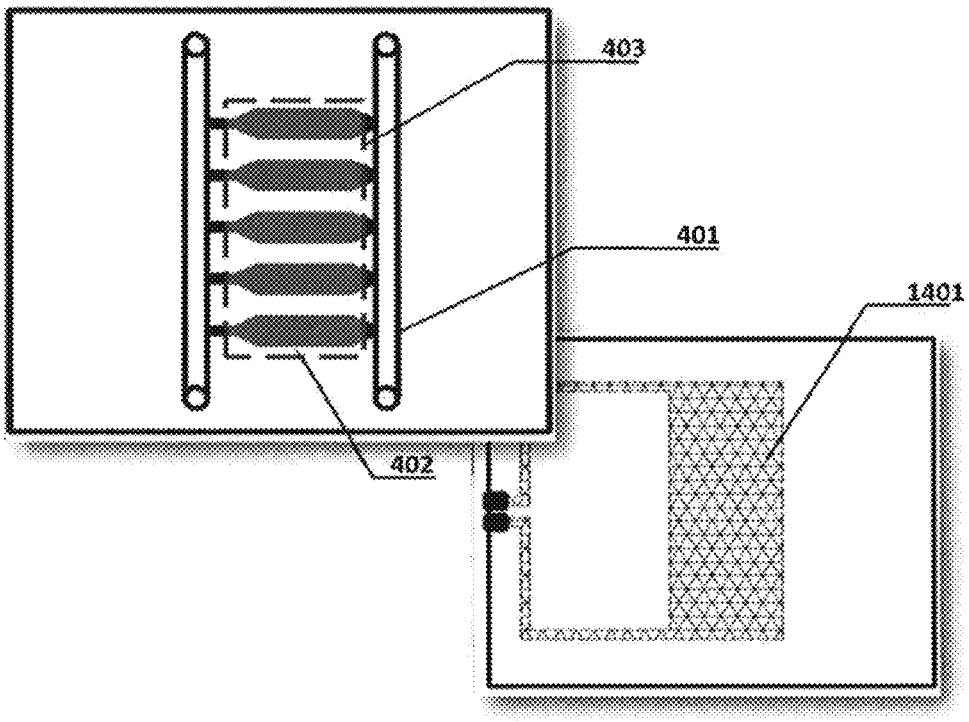
FIG. 13 is a diagram of microfluidic chip in embodiment 6.

As shown in FIG. 13, the chip in embodiment 6 is similar to embodiment 1 but it contains three layers that the upper layer is a 4 mm PMMA cover plate, the middle layer is a 0.05 mm PDMS film and the lower layer is a 2 mm glass substrate. A microreactor array is set on the lower surface of the upper cover plate which is designed by the technical solutions of patent CN1996009B. The middle PDMS film has no structure and the cooling lines 1401 is set on the upper surface of lower glass substrate, the cooling lines 1401 is in the position corresponding to microcells 402 to form local temperature control area 403; the depth of the structure of lower glass substrate is 0.2 mm which can be achieved by wet etching or other prior art. Convey ambient air to the cooling lines 1401 by a diaphragm pump only to cool the microcell area 402 and avoid cooling the main channel 401.

The reagent distribution process is the same as embodiment 1, seals the inlet and outlet of chip and put it into a dryer for integral heating at 70° C.; use a diaphragm pump to convey outside ambient air to cooling lines 1401 at the same time and the flow rate shall be 1 L/min.

Take the chip out after one hour. It shows that the reagent volume of each microcell almost remains unchanged. Only a small amount of bubbles are in microcells, no liquid drop or liquid film appears in main channel, which illustrates that the homogeneity and independence of microcells can be ensured.

Embodiment 7

The local temperature control area is in main channel, the local temperature control device is Peltier.

Figure 14:
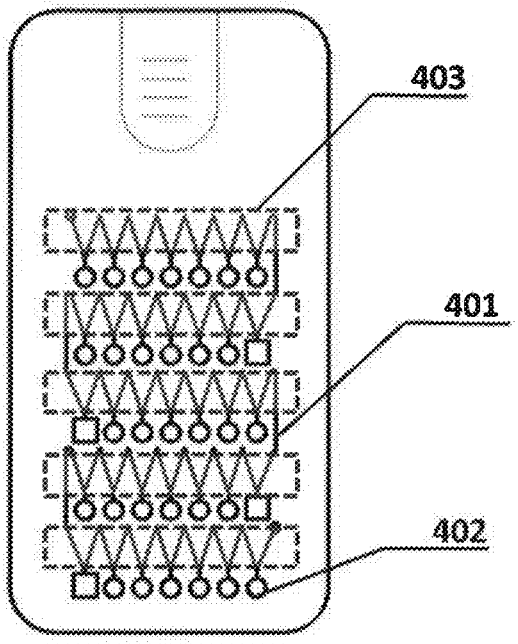
FIG. 14 is a diagram of microfluidic chip in embodiment 7.

As shown in FIG. 14, the chip in embodiment 7 is similar to embodiment 2 in shape, but the microcells array is rectangle, that is to say the microcell 402 is in rectangle arrangement; there is no buffer area, no rotation axis location hole. Other sizes are the same as embodiment 2.

The chip comprises 5-row connected main channel 401 in rectangle arrangement; each row of the main channel 401 is linked by several V lines and the top of each V line is connected to the microcells 402; local temperature control device comprises Peltier 1602, five aluminium blocks with thermal conductivity 1601 is set on Peltier 1602; when Peltier 1602 is used with the substrate, five aluminium blocks with thermal conductivity 1601 are in the position corresponding to the main channel 401 to form local temperature control area 403.

Figure 15:
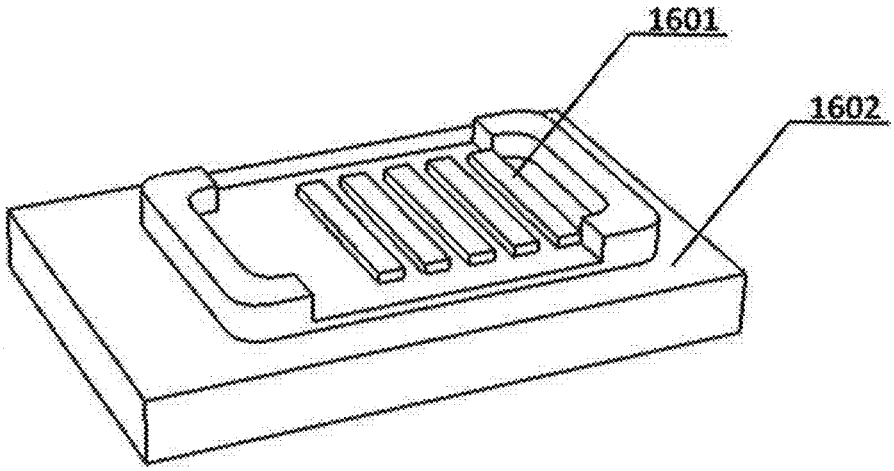
FIG. 15 is a diagram of Peltier in embodiment 7.

As shown in FIG. 15, Peltier 1602 is used to heat local temperature control area 403. Aluminium blocks with thermal conductivity 1601 fit closely together to lower PMMA plate of the chip and correspond to local temperature control area 403 during the heating process. Even if microcell 402 is not heated, it still keeps a lower temperature due to heat transfer process.

Figure 16:
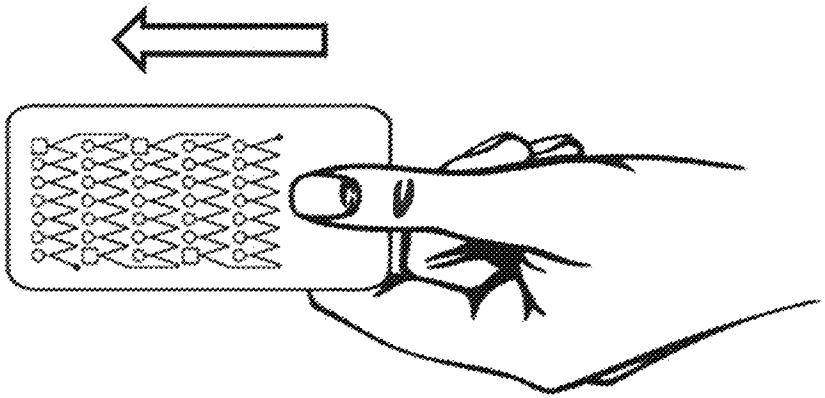
FIG. 16 is a diagram of the microfluidic chip with manual centrifugal in embodiment 7.

The reagent distribution process needs no injection pump or centrifugal machine in this example. Add samples into main channel 401 by manually operating pipettor and then seal the injection inlet and outlet. As shown in FIG. 16, hold the chip and throw it down using wrist or elbow as axis, (like shaking off water drop on hands). The reagent flows into the microcells 402 from the main channel 401 and the remaining air is in main channel 401, therefore, the reagent distribution process is completed.

The chip is put into a detecting instrument to control the temperature of Peltier heating module at 72° C.; the actual temperature of the microcells 402 is 67° C., hence the temperature of local temperature control area 403 is higher than that in microcells 402 during the whole detection process.

Take the chip out after heating one hour. It shows that the reagent volume of each microcell almost remains unchanged by microscope, no liquid drop or liquid film appears in main channel, which illustrates that the homogeneity and independence of microcells can be ensured.

INDUSTRIAL APPLICATION

The invention provides a microfluidic chip to be used under a local temperature control device. The reagent in microcells will not condensed in the main channel, therefore the reagent volume of each microcell remains unchanged to guarantee the homogeneity of microcells and there has no liquid film connecting with each microcell in main channel to ensure independence of microcells.

The invention claimed is:

1. A microfluidic chip comprising a substrate and a cover plate, the substrate being fitted with a microreactor array, the microreactor array comprising at least one main channel and at least two microcells connecting with the main channel respectively, wherein the microfluidic chip further comprises at least one local temperature control device for heating the main channel or cooling the microcells, wherein the main channel is a circular main channel, wherein the main channel comprises several linked V lines; wherein the microcells comprise connected buffer area and reaction area; wherein the top of each V line is connected with the buffer area;

wherein the local temperature control device is a circular resistive film, the resistive film is set in the substrate or cover plate and keeps a distance between the substrate or cover plate; the resistive film is in the position corresponding to the main channel.

2. The microfluidic chip according to claim 1, wherein the distance between the resistive film and substrate or the cover plate is larger than 0 and smaller than or equal to 0.5 mm; wherein a location hole is set in the substrate or cover plate in the position corresponding to the hollow part of resistive film.

3. The microfluidic chip according to claim 1, wherein the upper surface of the substrate is hydrophobicated with silylating reagent;

wherein the cover plate is an aluminum foil;

wherein the microfluidic chip also comprises a mechanical deformation device, the boss of the mechanical deformation device provides with several cylindrical embossments, the cylindrical embossments is in a circular array and in the position corresponding to the buffer areas.

4. A method to guarantee the homogeneity and independence of a plurality of microcells in the microfluidic chip according to claim 3, comprising:

opening the local temperature control device to heat the main channel or cool the microcells, controlling that the temperature of main channel is higher than the temperature in microcells, to guarantee the homogeneity and independence of each microcell.

5. A method to guarantee the homogeneity and independence of a plurality of microcells in the microfluidic chip according to claim 1, the method comprising:

opening the local temperature control device to heat the main channel or cool the microcells, controlling that the temperature of main channel is higher than the temperature in microcells, to guarantee the homogeneity and independence of each microcell.

6. A method to guarantee the homogeneity and independence of a plurality of microcells in the microfluidic chip according to claim 2, the method comprising:

opening the local temperature control device to heat the main channel or cool the microcells, controlling that the temperature of main channel is higher than the temperature in microcells, to guarantee the homogeneity and independence of each microcell.

* * * * *